United States Patent [19]

De Winter et al.

[11] 4,215,196

[45] Jul. 29, 1980

[54] PHOTOGRAPHIC ELEMENTS IN WHICH GELATIN SILVER HALIDE LAYERS CONTAIN POLYMERS WITH SEMICARBAZONE OR ALKOXY CARBONYL HYDRAZONE GROUPS

[75] Inventors: Walter F. De Winter, 's-Gravenwezel; Daniël M. Timmerman, Mortsel; Arthur H. De Cat, Mortsel; Godfried A. Kockelbergh, Mortsel, all of Belgium

[73] Assignee: AGFA-GEVAERT N.V., Mortsel, Belgium

[21] Appl. No.: 806,523

[22] Filed: Jun. 14, 1977

[30] Foreign Application Priority Data

Jun. 29, 1976 [GB] United Kingdom ..... 27053/76
Jan. 19, 1977 [GB] United Kingdom ..... 2149/77

[51] Int. Cl.[2] ..... G03C 1/72
[52] U.S. Cl. ..... 430/627; 430/630
[58] Field of Search ..... 96/114

[56] References Cited

U.S. PATENT DOCUMENTS

| | | | |
|---|---|---|---|
| 2,882,156 | 4/1959 | Minsk | 96/114 |
| 2,972,537 | 2/1961 | Laakso et al. | 96/114 |
| 3,740,228 | 6/1973 | Ohlschlager et al. | 96/114 |

*Primary Examiner*—Jack P. Brammer
*Attorney, Agent, or Firm*—A. W. Breiner

[57] ABSTRACT

Abrasion marks by dry-friction and the tendency of producing pressure-scratches in photographic materials is reduced by incorporating in the gelatin silver halide emulsion layers polymeric compounds containing recurring units with semicarbazone or alkoxy carbonyl hydrazone groups in the side-chains. These recurring units are represented by one of the formulae:

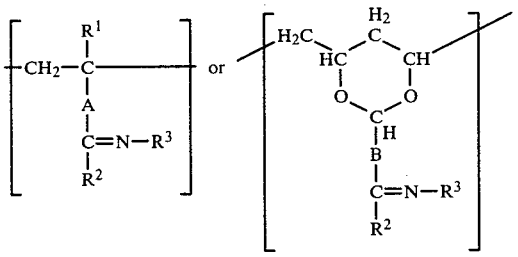

wherein:

A is a single bond or —CONH-alkylene-, —COO-alkylene-, or phenylene,

B is a single bond or alkylene, $R^1$ is hydrogen or methyl, $R^2$ is hydrogen, phenyl or lower alkyl (1–4 C), $R^3$ is —NH—COOR or

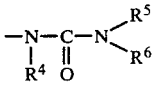

wherein R is lower alkyl (1–4 C) and each of $R^4$, $R^5$ and $R^6$ is hydrogen or lower alkyl (1–4 C).

3 Claims, No Drawings

PHOTOGRAPHIC ELEMENTS IN WHICH GELATIN SILVER HALIDE LAYERS CONTAIN POLYMERS WITH SEMICARBAZONE OR ALKOXY CARBONYL HYDRAZONE GROUPS

The invention relates to improved photographic gelatin silver halide emulsion layers.

It is known that gelatin silver halide emulsion layers are subject to abrasion by dry-friction and show a tendency of being pressure-scratched upon manipulation in the exposure and processing apparatuses. These dry-friction marks and pressure scratches are reproduced in the final photographic images.

It has now been found that the production of abrasion marks by dry-friction may be decreased and that the tendency of producing pressure-scratches that are visible in the final photographic images may be reduced effectively when the gelatin silver halide emulsion layers comprise polymeric compounds containing recurring units with semicarbazone or alkoxy carbonyl hydrazone groups in the side-chain.

The present invention therefore provides new polymeric compounds comprising recurring units with semicarbazone or alkoxy carbonyl hydrazone groups in the side-chain as well as photographic elements comprising a support and at least one radiation-sensitive gelatin silver halide emulsion layer comprising a polymeric compound containing recurring units with semicarbazone or alkoxy carbonyl hydrazone groups in the side-chain.

The present invention also provides a method of producing improved photographic images by processing exposed photographic gelatin silver halide emulsion layers comprising a polymeric compound containing recurring units with semicarbazone or alkoxy carbonyl hydrazone groups in the sidechain. It was surprisingly found that these polymeric compounds containing recurring units with semicarbazone or alkoxy carbonyl hydrazone groups effectively reduce the formation of dry-friction abrasion and pressure marks upon processing in the usual photographic baths.

The polymeric compounds comprising semicarbazone or alkoxy carbonyl hydrazone groups in the side-chain are homopolymers or copolymers. These homopolymers and copolymers may be obtained by condensation of semicarbazides or of alkoxy carbonyl hydrazines with homopolymers or copolymers derived from monomers comprising a keto-carbonyl group, e.g. vinyl alkyl ketone, vinyl aryl ketone, acrolein, vinylacetophenone or vinyl acetals, N-alkyl(meth)acrylamides and alkyl(meth)acrylates comprising a keto-carbonyl group in the alkyl group.

The above monomers comprising a keto-carbonyl group may also be made to react with semicarbazides or with alkoxy carbonyl hydrazines to form monomers containing semicarbazone or alkoxy carbonyl hydrazone groups, and these monomers may be homopolymerized or copolymerized with suitable other monomers by solution- or emulsion-polymerization processes, to form homopolymers or copolymers comprising semicarbazone or alkoxy carbonyl hydrazone groups in the side-chains.

The recurring units with semicarbazone or alkoxy carbonyl hydrazone groups in the side-chain can be represented by one of the formulae:

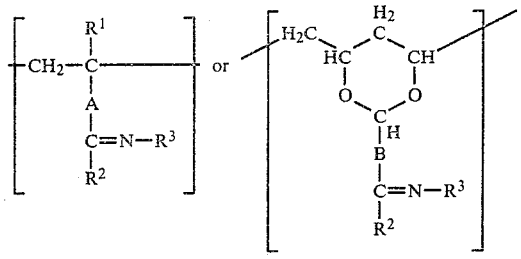

wherein

A is a single bond or a bivalent organic group, e.g. —CONH— alkylene—, —COO-alkylene—, and phenylene, B is a single bond or alkylene, $R^1$ is hydrogen or methyl, $R^2$ is hydrogen, phenyl or lower alkyl (1–4 carbon atoms), $R^3$ stands for —NH—COOR or

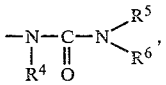

wherein R is a lower alkyl (1–4 carbon atoms), preferably ethyl, and each of $R^4$, $R^5$ and $R^6$ is hydrogen or lower alkyl (1–4 carbon atoms).

The homopolymers comprising semicarbazone or alkoxy carbonyl hydrazone groups in the side-chains are insoluble in water. Copolymers, however, may be water-soluble or not. When they are water-soluble they can be mixed directly in the form of their aqueous solutions with aqueous gelatin silver halide emulsions. On the contrary, homopolymers and copolymers that are water-insoluble may be added in the form of primary aqueous dispersions obtained by emulsion-homopolymerization or -copolymerization processes, or they may be added as secondary dispersions obtained by solution-homopolymerization or -copolymerization followed by dispersion in aqueous medium. The comonomers possibly present are chosen in such a way that they do not impair and even promote the compatibility of the aqueous dispersions of the copolymers produced with aqueous gelatin solutions, so that their mixtures after drying form fully transparent layers.

To form water-soluble copolymers, the monomers containing semicarbazone or alkoxy carbonyl hydrazone groups—or the monomers with ketocarbonyl groups which after polymerization are condensed with semicarbazides or with alkoxy carbonyl hydrazines as referred to hereinbefore—are copolymerized with a suitable amount of ethylenically unsaturated hydrophilic monomers. Examples of these hydrophilic monomers are vinyl alcohol, (meth)acrylic acid, maleic acid, (meth)acrylamides, N-alkyl(meth)acrylamides, alkyl (meth)acrylates, sulphoalkyl (meth)acrylates, monomaleate esters, and N-vinylpyrrolidone. Moreover, the water-soluble copolymers may comprise other recurring units derived from e.g. styrene, acrylonitrile, vinyl acetate, and other vinyl esters, produced these latter recurring units are only present in such an amount that the final copolymers remain water-soluble.

Particularly suitable compounds are copolymers comprising recurring units with semicarbazone or alkoxy carbonyl hydrazone group in the side-chains, which are derived from vinyl alkyl ketone units, e.g. vinyl methyl ketone units, diacetone(meth) acrylamide units, and acetonyl (meth)acrylate units.

The effectiveness of the polymeric compounds for use according to the present invention is due to the recurring units with semicarbazone or alkoxy carbonyl hydrazone group in the side-chain. The possibly copolymerized monomers should be such that they have no deleterious effect on the photographic properties of the silver halide emulsion layers. They are preferably chosen so that they make the copolymers soluble in the aqueous gelatin medium of the emulsion, or so that they do not impair and even promote the compatibility of the aqueous dispersions of the copolymers with the aqueous gelatin medium.

The copolymers employed comprise at least about 5 mole%, preferably at least about 25 mole% of units comprising a semicarbazone or alkoxy carbonyl hydrazone group.

Though the molecular weight of the polymeric compounds used is of minor importance and the best range can easily be determined by means of some simple tests, the compounds generally have a molecular weight comprised between about $10^3$ and about $10^7$, such that they are fast to diffusion in the layers wherein they are present.

The polymeric compounds may be added to the silver halide emulsion during no matter what step of emulsion preparation, preferably just before coating on a suitable support e.g. paper, or film such as cellulose triacetate and polyethylene terephthalate.

The amount of polymeric compound employed in the lightsensitive silver halide emulsion layer depends on the particular polymeric compound, the molar ratio of units containing semicarbazone or alkoxy carbonyl hydrazone groups present in the polymeric compound, the particular type of gelatin silver halide emulsion and the desired effect, and can vary within very wide limits. The optimum amount of each individual polymeric compound to be added is preferably determined by trial for each particular type of emulsion. In general, good results are obtained when at least 5% by weight, preferably about 20% by weight, of polymeric compound is added, with respect to the weight of hydrophilic colloid, more particularly of gelatin present, provided the polymeric compound comprises 50 mole % of recurring units containing a semicarbazone or alkoxy carbonyl hydrazone group in the side-chain. For polymeric compounds wherein the content of semicarbazone or of alkoxy carbonyl hydrazone groups is different from 50 mole %, the above preferred concentration can easily be adapted accordingly.

The polymeric compounds of use according to the present invention may be added to any type of light-sensitive silver halide emulsion. Various silver salts may be used as light-sensitive salt, e.g. silver bromide, silver iodide, silver chloride, or mixed silver halides, e.g. silver chlorobromide or silver bromoiodide. The invention is of particular importance for rapid processing of silver bromoiodide emulsions.

The emulsion may be a negative emulsion or a direct-positive emulsion, which comprises fogged silver halide. In direct-positive emulsions fogging may be effected by known means, e.g. by light and preferably, by chemical sensitization to fog e.g. by means of reducing agents such as hydroxylamine, hydrazine, formaldehyde, tin(II) chloride, thiourea dioxide, etc., and/or by means of noble metal compounds such as gold compounds. In addition thereto fogging may also occur by increasing the pH of the emulsion by means of alkaline substances such as sodium or potassium hydroxide.

The silver halides are dispersed in the common hydrophilic colloids such as gelatin, casein, zein, polyvinyl alcohol, carboxymethylcellulose, alginic acid, etc., gelatin, however, being favoured.

The silver halide emulsions of the radiation-sensitive elements comprising the polymeric compounds in accordance with the present invention may be chemically as well as spectrally sensitized. They may also comprise the common emulsion stabilizers, surface-active compounds, plasticizers, matting agents, hardening agents and hardening accelerators.

In the following preparations examples are given of polymeric compounds, which were found to be particularly suitable and which contain recurring units with semicarbazone or alkoxy carbonyl hydrazone groups in the side-chain.

PREPARATION 1

Synthesis of co(diacetone acrylamide/acrylic acid)

A 5 liter reaction vessel was provided with a stirring device, a nitrogen inlet, and a reflux condenser. Then 77.88 g of diacetone acrylamide, 22.12 g of acrylic acid, and 1 g of azobis-isobutyronitrile dissolved in 250 ml of a 3:1 by volume mixture of ethanol and water were introduced in the reaction vessel.

The mixture was heated at 70° C. with stirring, while a stream of nitrogen gas was introduced. At this temperature a slight reflux took place. The copolymerization occurred progressively without exothermic phase. After a reaction period of 4 h at 70° C. the viscous solution was poured with stirring in 3 l of demineralized water that had been acidified with 50 ml of 5 N hydrochloric acid.

The precipitate was washed with demineralized water until neutral and then, without drying, dissolved in a 3:1 by volume mixture of ethanol and water. Yield: 600 g of solution containing 16.6 g of copolymer per 100 g of solution.

By analysis it was found that the copolymer comprised 1.1% of water, 2.85 m.eq. of COOH/g of product, and 6.43–6.52% of nitrogen, from which it could be derived that the copolymer comprised 38.1 mole % of acrylic acid and 61.9 mole % of diacetone-acrylamide.

PREPARATION 2

In an analogous way as described in preparation 1, 70.12 g of diacetone acrylamide, 29.88 g of acrylic acid, and 1 g of azobis-isobutyronitrile were dissolved in 250 ml of the 3:1 by volume mixture of ethanol and water. The solution was treated as in preparation 1 to give a copolymer comprising 51.7 mole % of diacetone acrylamide and 48.3 mole % of acrylic acid.

PREPARATION 3

In an analogous was as described in preparation 1, 61.01 g of diacetone-acrylamide, 38.99 g of acrylic acid and 1 g of azobis-isobutyronitrile were dissolved in 250 ml of 3:1 by volume mixture of ethanol and water. After copolymerization as indicated in preparation 1 a copolymer was obtained comprising 41.8 mole % of diacetone acrylamide and 58.2 mole % of acrylic acid.

PREPARATION 4:

Preparation of copolymer containing units with semicarbazone groups in the side chain 542 g of the solution obtained in preparation 1 were introduced into a 1 liter reaction vessel provided with a stirrer and a reflux condenser. Then 48.54 g of semicarbazide hydrochloride (0.435 mole) were added at once to this copolymer solution and the resulting mixture was heated at 50° C. Subsequently a solution of 88.27 g of sodium acetate-3-water in 100 ml of water was added dropwise in 7 min. The reaction mixture was heated for 3 h at 55° C. with stirring.

Subsequently, the solution was cooled at 35° C. and poured with stirring into 8 liters of demineralized water that had been acidified with 190 ml of 5 N hydrochloric acid.

The polymer was filtered, washed with demineralized water until neutral, and dried under vacuum at 100° C. Yield: 108.9 g.

By analysis it was found that the copolymer comprised 1.1% of water, 17.01–17.21% of nitrogen, and 2.37 m.eq. of COOH/g of product. It could be derived therefrom that the copolymer corresponded to the following formula:

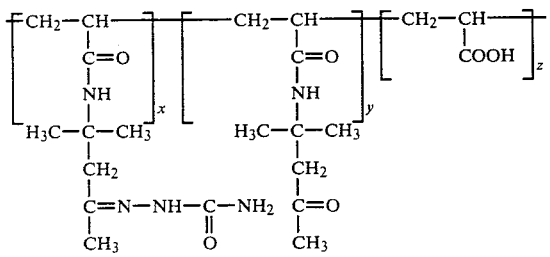

wherein:

X=43.2 mole % y=18.6 mole % z=38.2 mole %

PREPARATION 5

The process of preparation 4 was repeated with 528 g of the copolymer of preparation 2, 42.28 g of semicarbazide hydrochloride, and 77.35 g of sodium acetate-3-water dissolved in 90 ml of demineralized water.

By analysis it was found that the copolymer produced comprised 1.9% of water, 14.15–14.25% of nitrogen, and 3.40 m.eq. of COOH/g of copolymer. It could be derived therefrom that the copolymer corresponded to the same formula as in preparation 4, but wherein x=30.93 mole % y=20.64 mole % z=48.43 mole %

PREPARATION 6

The process of preparation 4 was repeated with 548 g of the copolymer of preparation 3, 38.48 g of semicarbazide hydrochloride, and 60.39 g of sodium acetate-3-water dissolved in 80 ml of demineralized water.

By analysis it was found that the copolymer produced comprised 1.5% by water, 15.25–15.55% of nitrogen, and 4.32 m.eq. of COOH/g of copolymer. It could be derived therefrom that the copolymer corresponded to the same formula as in preparation 4, but wherein x=35.56 mole % y=6.24 mole % z=58.20 mole %

PREPARATION 7

Synthesis of co(acetonyl acrylate/acrylic acid)

In a 1 liter reaction vessel provided with a nitrogen inlet, a stirrer and a reflux condenser, a solution of 156.5 g of acetonyl acrylate, 88 g of acrylic acid, and 2.44 g of azobisisobutyronitrile in 608 ml of a 3:1 by volume mixture of ethanol and water was introduced.

The homogeneous solution was heated at 80° C. with stirring and introduction of nitrogen. The polymerization was exothermic so that an energetic reflux took place. After 5–10 minutes of refluxing, heating was continued with stirring until 75° C.

After a total polymerization period of 5 h, the copolymer was isolated by pouring the viscous polymer solution in 7 l of demineralized water. A fibrous copolymer precipitated. It coagulated to a plastic polymer mass, which was washed with demineralized water and then dissolved in a 3.6:1 by volume mixture of ethanol and water. Yield: 1066 g of solution containing 21.8 g of copolymer per 100 g of solution.

By analysis it was found that the copolymer comprised 0.9% of water and 5.69 m.eq. of COOH/g of product, from which there could be calculated that the copolymer comprised 55.6 mole % of acrylic acid and 44.4 mole % of acetonyl acrylate.

PREPARATION 8

Copolymer containing units with semicarbazone groups in the side-chain.

To 1014 g of the solution prepared in preparation 7, which was diluted with 140 ml of ethanol and 69 ml of water, 129.5 g of semicarbazide hydrochloride were added. The whole was heated at 55° C. with stirring. At this temperature a solution consisting of 236.96 g of sodium acetate-3-water dissolved in 300 ml of demineralized water was added dropwise in 25 min. Stirring was continued at 55° C. for 4 h.

Subsequently, the viscous solution diluted at 55° C. with 300 ml of a 3:1 by volume mixture of ethanol and water was poured into 15 liters of demineralized water that had been acidifed with 150 ml of concentrated hydrochloric acid.

The precipitated copolymer was dried under vacuum at 100° C. until constant weight. Yield: 240 g of copolymer.

By analysis it was found that the copolymer comprised 0.7% of water, 7.07–7.16% of nitrogen, and 5.14 m.eq. of COOH/g of product, from which there could be calculated that the copolymer corresponded to the formula:

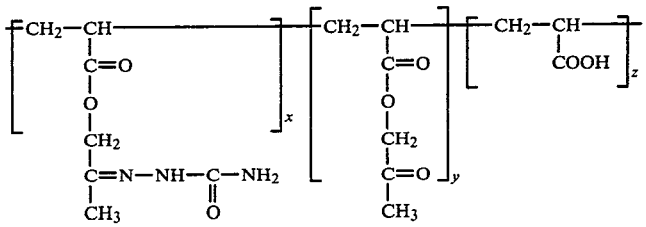

wherein
x=18.3 mole %
y=26.1 mole %
z=55.6 mole %

PREPARATION 9

Synthesis of acetal copolymer comprising semicarbazone groups

A. 110 g of poly(vinyl alcohol) having a molecular weight of about 40,000, dissolved in a mixture of 500 ml acetone and 500 ml of acetic acid were introduced into a 1 liter reaction vessel provided with a stirrer, a reflux condenser, and a thermometer. The whole was heated at the reflux temperature of 98° C.

10 g of p-toluene sulphonic acid 90% were added. At reflux temperature 33 g of 3-keto-butyraldehyde dimethyl acetal were added with stirring in about 45 min. At the start of the addition the reflux temperature was 97° C. but gradually this temperature was lowered to 77° C.

Stirring was then continued for 1 h at reflux temperature.

The polymer solution was poured with stirring in 10 l of methanol. The precipitate was washed with methanol and then was redissolved in 900 ml of water. This solution was adjusted to pH 8 with concentrated ammonium hydroxide and poured into 7.5 liters of methanol.

After filtration and drying 125 g of copolymer were obtained corresponding to the formula:

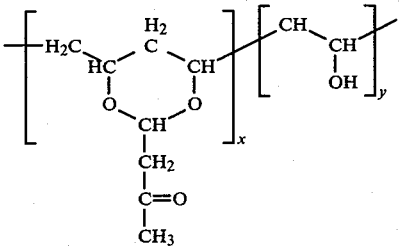

wherein
x=10 mole %
y=90 mole %

B. 100 g of the above copolymer were dissolved in 500 ml of demineralized water. The solution was admixed with 22.5 g of semicarbazide hydrochloride. The whole was heated with stirring at 60° C.

In about 25 min a solution of 27.2 g of sodium acetate-3-water in 50 ml of demineralized water was added. Stirring was continued for some time at 55° C., whereupon the viscous solution was diluted with 200 ml of a 1:1 by volume mixture of methanol and water, and then poured into 10 ml of methanol.

The precipitated polymer was filtered, washed with 1 l of fresh methanol, and finally vacuum-dried at 100° C. until constant weight. Yield: 105 g of copolymer of the formula

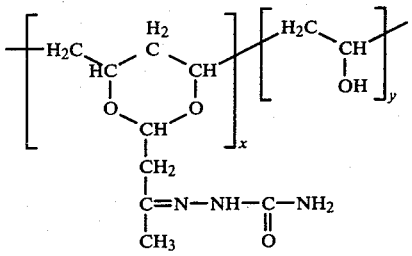

wherein:
x=10 mole %
y=90 mole %
A few units of unsubstituted 3-keto-butyraldehyde acetal were also present.

PREPARATION 10

2-methyl semicarbazide was prepared according to the method described in J. Amer. Chem. Soc., 81, 2462 (1959).

To 1014 g of the solution of co(acetonyl acrylate/acrylic acid) produced in preparation 7 diluted with 140 ml of ethanol and 69 ml of water, 103.4 g of 2-methyl semicarbazide were added. The whole was heated at 55° C. and stirring was continued for 4 h.

Thereafter the viscous solution, diluted at 55° C. with 300 ml of a 3:1 by volume mixture of ethanol and water, was poured into 15 l of demineralized water that had been acidified with 50 ml of concentrated hydrochloride acid. Yield: 245 g of copolymer.

By analysis it was found that the copolymer comprised 1.0% of water, 9.08–8.88% of nitrogen, and 4.96 m.eq. of COOH/g of product. It could be derived therefrom that the copolymer corresponded to the formula:

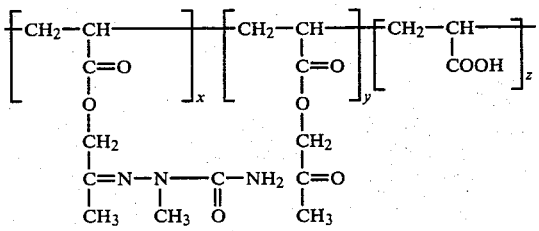

wherein
x=24.0 mole %
y=20.4 mole %
z=55.6 mole %

PREPARATION 11

The process described in preparation 4 was repeated with the exception that the 48.54 g of semicarbazide hydrochloride were replaced by 38.71 g of 2-methyl semicarbazide and that no sodium acetate was added. Upon precipitation in water only 50 ml of 5N hydrochloric acid were used instead of the 190 ml per 8 liters of demineralized water. Yield: 107 g of copolymer.

By analysis it was found that the copolymer comprised 1.8% of water, 11.06–11.18% of nitrogen and 2.31 m.eq. of COOH/g of copolymer. It could be derived therefrom that the copolymer corresponded to the formula:

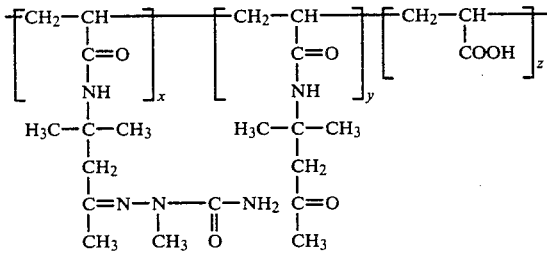

wherein x=44.0 mole % y=17.8 mole % z=38.2 mole %

PREPARATION 12

Solution copolymerization of acrylic acid and (2-dimethyl-2-acryloylamido)ethyl, methyl ketone semicarbazone An amount of 5N sodium hydroxide necessary to adjust the pH at 8.5 was added with stirring to 24.53 g of semicarbazide hydrochloride in 50 ml of methanol.

100 ml of methanol were added to the solution and the precipitated sodium chloride was filtered off. The filtrate was made anhydrous with 40 g of sodium sulphate.

The dispersion was stirred and cooled at 5° C., whereupon the sodium chloride and sodium sulphate salts were filtered off. These salts were washed with methanol. In this way 200 ml of filtrate containing 16.5 g of semicarbazide set free from the semicarbazide hydrochloride were obtained.

The above solution was introduced in a new reaction vessel together with a solution of 33.8 g of diacetone acrylamide in 16 ml of acetic acid. The whole mixture was heated to 65° C.

The mixture was stirred at this temperature for 1 h and then cooled at 2° C., so that a quantity of crystalline product was formed. The whole mixture was filtered and the filtrate was again evaporated until a quantity of but 75 ml remained. Subsequently it was cooled at 2° C. so that again a quantity of crystalline product formed.

Both crystalline mixtures were filtered off and dried at room temperature under vacuum until constant weight.

Yield: 48 g of crude (2-dimethyl-2-acryloylamido)-ethyl methyl ketone semicarbazone. This monomer was purified by recrystallization from 200 ml of water. Upon heating at 75° C. with stirring a small amount of insoluble homopolymer was filtered off. The filtrate was allowed to crystallize overnight.

Yield: 37.4 g of crystalline, anhydrous (2-dimethyl-2-acryloylamido)-ethyl methyl ketone semicarbazone monomer, melting at 197° C. The structure was confirmed by elemental nitrogen analysis (24.66–24.70% N) and by N.M.R. analysis.

22.60 g of the above monomer and 7.2 g of acrylic acid were dissolved at 65° C. in a mixture of a 2:1 by volume of methanol and water, so that 100 ml of solution were obtained. A stream of dry nitrogen gas was continuously bubbled through the solution. Subsequently a solution of 300 mg of potassium persulphate in 20 ml of water was added.

After 16 h the slightly viscous warm polymer solution was poured out in 1 l of water with stirring. The white polymeric precipitate was filtered off and dried at 50° C. under vacuum until constant weight.

Yield: 22 g of co(acrylic acid/(2-dimethyl-2-acryloylamido)-ethyl methyl ketone semicarbazone) comprising 50 mole % of acrylic acid.

PREPARATION 13

Emulsion copolymerization of ethyl acrylate and (2-dimethyl-2-acryloylamido)-ethyl methyl ketone semicarbazone 15 g of (2-dimethyl-2-acryloylamido)-ethyl methyl ketone semicarbazone prepared as described in the first part of preparation 12 were dissolved with heating in 100 ml of water together with 50 ml of a 10% solution in water of HOSTAPON (trade-name of Farbwerke Hoechst, Frankfurt, W-Germany) for an emulsifying agent essentially consisting of sodium oleylmethyltauride.

Subsequently, the solution was cooled to room temperature, mixed with 85 g of ethyl acrylate and 1 g of potassium persulphate, and under vigorous stirring diluted with demineralized water until 500 ml of emulsion was obtained.

100 ml of this emulsion were introduced in a reaction vessel provided with a reflux condenser, a nitrogen inlet, and a thermometer.

The emulsion was slowly heated at 80° C., whilst a stream of nitrogen gas was bubbled therethrough.

After 15 min the remaining 400 ml of emulsion from the first reaction vessel were dropped into the second vessel in about 55 min, whereafter the reaction mixture was stirred for 2 h at 80° C.

Subsequently, the dispersion was cooled at room temperature and filtered through nylon cloth.

Yield: 485 ml of latex comprising 20.1 g of dry product per 100 ml of latex. The copolymer was composed of 85% by weight of ethyl acrylate and 15% by weight of (2-dimethyl-2-acryloylamido)-ethyl methyl ketone semicarbazone, which corresponded with a mole ratio content of 92.8 and 7.2 mole % respectively.

PREPARATION 14

Preparation of copolymer containing units with alkoxy carbonyl hydrazone groups in the side-chain.

56.63 g of the copolymer from Preparation 2 dissolved in 161.4 g of a 50:50 by volume mixture of ethanol and water were introduced at room temperature in a reaction vessel provided with a stirrer, a reflux cooler and a thermometer. The solution was brought at pH 7 with 33.8 ml of 5 N sodium hydroxide.

To the neutralized solution were added 34 g of ethyl ester of hydrazine carboxylic acid and the mixture was heated at 65° C.

After 6 h of reaction at 65° C. the copolymer containing ethoxycarbonyl hydrazone groups was isolated by pouring the solution with stirring in a mixture of 2 liters of demineralized water and 50 ml of 12 N hydrochloric acid. A tacky polymer mass was obtained, which after being dissolved in 500 ml of methanol was once again isolated in the same way.

The copolymer was washed with demineralized water until the wash water was completely free of acid. The tacky polymer was dissolved in 400 ml of methanol, adjusted to pH 7 with about 40 ml of 5 N sodium hydroxide and finally evaporated under vacuum to obtain 400 ml of solution. This solution contained 20.3 g of copolymer per 100 ml of solution.

For analysing purposes 30 ml of the above solution was poured in 200 ml of demineralized water containing 10 ml of 12 N hydrochloric acid and after washing and drying, the precipitated polymer was analysed:

nitrogen content: 9.87–9.93% water content: 2.25%

It could be derived therefrom and from the knowledge of the composition of the copolymer of Preparation 2 that the copolymer corresponded to the formula:

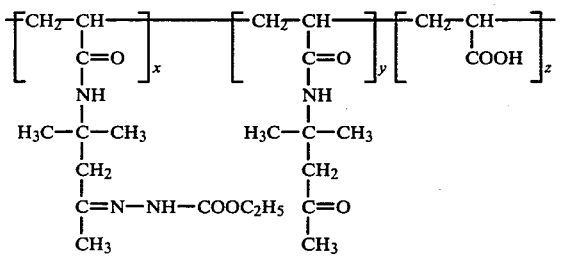

wherein x=26.8 mole % y=24.9 mole % z=48.3 mole %

PREPARATION 15

Synthesis of acetal copolymer comprising ethoxycarbonyl hydrazone groups 50 g of the acetal copolymer obtained in Preparation 9A were dissolved in 300 ml of demineralized water and the solution was heated with stirring at 60° C. Then 9.56 g of ethoxycarbonyl hydrazine were added at 60° C. and during the reaction the temperature was kept constant at this temperature.

After 6 h of reaction the viscous solution formed was diluted with 100 ml of a 1:1 by volume mixture of methanol and water. The precipitated polymer was filtered off, washed with 0.5 l of fresh methanol and finally vacuum-dried at 60° C. Yield: 56 g of copolymer corresponding to the formula

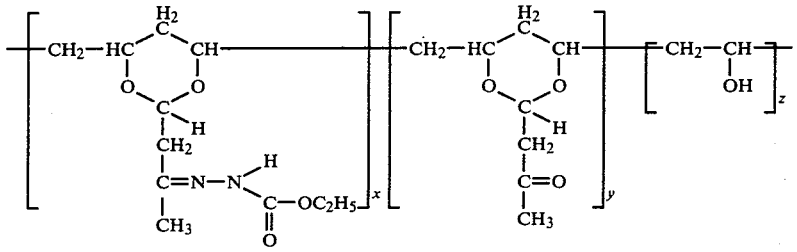

wherein:

x=9 mole % y=1 mole % z=90 mole %.

The polymers comprising recurring units containing semicarbazone or alkoxy carbonyl hydrazone groups when added to photographic gelatin silver halide emulsion layers reduce the abrasion by dry-friction as well as the pressure-scratchability of these layers. Materials comprising the above copolymers can be tested in the following way.

1. Friction test with turntable

Two sheets (each of them measuring 10 cm×10 cm) of the photographic material to be tested are placed in complete darkness upon each other with their emulsion sides facing each other. The lower sheet is kept motionless, whereas the upper sheet is rotated to and fro through a given angle, a predetermined weight pressing both sheets together.

The photographic material is then developed and fixed as usual, so that the black friction marks become visible in the developed material.

2. Black scratch test

Strips of the material to be tested (measuring 35 mm×274 mm) are treated with a scratching device in complete darkness. A spherical ball having a radius of 3.16 mm is drawn over the light-sensitive material, while being charged with increasing weights. Subsequently, the material is developed and fixed, so that the black scratches resulting from the ball impression become visible.

In both cases the blackening due to abrasion by dry-friction and to scratching by pressure is evaluated by numbers from 1 to 4. Herein the evaluation 1 is given to a material wherein only traces of blackening are found, whereas 4 is given to materials wherein substantial blackening is noted.

The following examples illustrate the present invention.

EXAMPLE 1

A conventional sulphur- and gold-sensitized gelatin silver bromoiodide (1 mole % of iodide) emulsion, stabilized by addition of 5-methyl-7-hydroxy-s-triazolo[1.5-a] pyrimidine, hardened with formaldehyde and provided with the common coating aids, was divided into two aliquot portions. The copolymer comprising units with semicarbazone groups in the side chain, described in preparation 4, was added to one portion. This copolymer was added in such an amount that 20% by weight was present with respect to the dry weight of gelatin contained in the gelatin silver bromoiodide emulsion.

Both portions were coated on a photographic support provided with a known subbing layer. The dried light-sensitive layers were covered with a 1 μm thick antistress gelatin layer.

The two photographic materials were tested as described hereinbefore:

1. friction test with turntable
2. black scratch test.

Subsequently the materials were developed and fixed. The photographic properties of both materials such as relative sensitivity and gamma were measured in known manner and the scratchability and the dry-friction were judged visually as indicated above. The results were as follows:

| Emulsion layer | relative sensitivity | gamma | friction test | black scratch test |
|---|---|---|---|---|
| without copolymer | 100 | 4.84 | 4 | 3 |
| copolymer with semicarbazone groups added | 100 | 4.84 | 2 | 2 |

The addition to the photographic emulsion of the copolymer comprising units containing semicarbazone groups in the side chain resulted in a reduction of the abrasion by dry-friction and in a reduced pressure-scratchability of the photographic material. It was further noticed that the addition of the copolymer had no deleterious effect on the sensitometric properties of the silver halide emulsion layer.

EXAMPLE 2

The process of Example 1 was repeated with the sole difference that the copolymer of preparation 4 was replaced by a same amount of the copolymer comprising units with semicarbazone groups in the side-chain prepared in preparation 8.

The results of the tests were as follows:

| Emulsion layer | relative sensitivity | gamma | friction test | black scratch test |
|---|---|---|---|---|
| without copolymer | 100 | 4.68 | 4 | 3 |
| copolymer with semicarbazone groups added | 102 | 4.61 | 2 | 2 |

The addition of the copolymer also resulted in reduced abrasion by dry-friction and reduced pressure-scratchability. The addition of the copolymer had no deleterious effect on the photographic properties of the silver halide emulsion layer.

EXAMPLE 3

A conventional sulphur- and gold-sensitized gelatin silver bromoiodide emulsion (1 mole % of iodide), comprising per kg an amount of silver halide corresponding to 100 g of silver nitrate, 74 g of gelatin, 545 mg of 5-methyl-7-hydroxy-s-triazolo[1,5-a]pyrimidine and 6.5 mg of 1-phenyl-5-mercaptotetrazole was divided into two aliquot portions.

One of these portions remained as such, whereas the copolymer formed in Preparation 14 was added to the other in such amount that 20% by weight was present with respect to the dry weight of gelatin in the gelatin silver bromoiodide emulsion.

The two portions were coated on a polyethylene terephthalate film support, which had been provided with a known subbing layer composition. The dried light-sensitive layers were covered with a 1 μm thick antistress gelatin layer.

After exposure to light the samples were treated in a 90 seconds automatic developing device with a hardening developer containing hydroquinone/1-phenyl-3-pyrazolidinone as developing agents and glutar dialdehyde as hardening agent. The photographic properties of the two samples such as fog, relative sensitivity and gamma were measured in known manner.

The dry-friction was determined and judged visually as indicated above. The results were as follows:

| Emulsion layer | Fog | Log Et relative sensitivity | Gamma | Friction test |
|---|---|---|---|---|
| without copolymer | 0.27 | 1.41 | 4.84 | 4.0 |
| copolymer with ethoxycarbonyl hydrazone groups added | 0.25 | 1.36 | 4.76 | 1.5 |

The addition to the photographic emulsion of the copolymer comprising units containing ethoxycarbonyl hydrazone groups in the side-chain resulted in a reduction of the abrasion by dry-friction of the photographic material. It was further noticed that the addition of the copolymer had only a slight effect on the sensitometric properties of the silver halide emulsion layer.

The good results obtained above were due to the presence of the copolymer comprising ethoxycarbonyl hydrazone groups. Indeed, when this copolymer was replaced by a copolymer comprising more simple hydrazone groups, such as unsubstituted hydrazone groups or N-methyl-hydrazone groups, the same good results were not obtained. Such copolymers could be formed by replacing in Preparation 14 and 34 g of ethyl ester of hydrazine carboxylic acid by 10.24 g of unsubstituted hydrazine or by 18.56 g of N-methylhydrazine. The reaction with unsubstituted hydrazine resulted in a cross-linked copolymer that was completely insoluble in all common solvents, so that it could not be homogeneously mixed with the gelatin silver halide emulsion.

The copolymer comprising N-methyl hydrazone groups, when mixed with the gelatin silver halide emulsion, caused an inadmissible fogging of the light-sensitive emulsion so that the effect on dry-friction could not be evaluated.

We claim:

1. A photographic element comprising a support and at least one radiation-sensitive gelatin silver halide emulsion layer comprising a polymeric compound containing at least 5 mole % of recurring units with semicarbazone or alkoxy carbonyl hydrazone groups in the side-chain, wherein said recurring units correspond to one of the formulae:

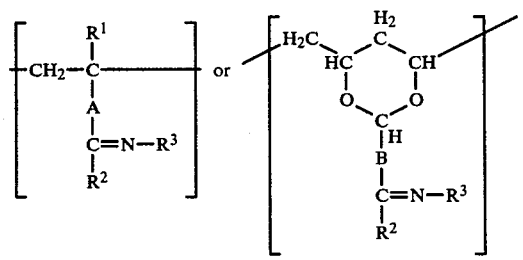

wherein:

A is a single bond or a bivalent organic group, taken from —CONH-alkylene-, —COO-alkylene-, and phenylene, B is a single bond or alkylene, $R^1$ is hydrogen or methyl, $R^2$ is hydrogen, phenyl or lower alkyl (1–4 carbon atoms), $R^3$ stands for -NH-COOR or $$-\underset{R^4}{N}-\underset{O}{C}-\overset{R^5}{\underset{R^6}{N}}$$

wherein R is a lower alkyl (1–4 carbon atoms), and each of $R^4$, $R^5$ and $R^6$ is hydrogen or lower alkyl (1–4 carbon atoms);

and wherein at least 5% by weight of said polymeric compound is present with respect to the gelatin content of the radiation-sensitive emulsion layer.

2. A photographic element according to claim 1, wherein the recurring units with semicarbazone or alkoxy carbonyl hydrazone groups in the side-chain are derived from vinyl alkyl ketone units, vinyl aryl ketone units, diacetone (meth)acrylamide units and acetonyl (meth)acrylate units.

3. A photographic element according to claim 1, wherein the polymer comprises besides the units with semicarbazone or alkoxy carbonyl hydrazone groups in the side-chain units of other ethylenically unsaturated monomers.

* * * * *